US010288070B2

(12) United States Patent
Akei et al.

(10) Patent No.: US 10,288,070 B2
(45) Date of Patent: May 14, 2019

(54) SCREW COMPRESSOR WITH OIL SHUTOFF AND METHOD

(71) Applicant: Carrier Corporation, Jupiter, FL (US)

(72) Inventors: Masao Akei, Cicero, NY (US); Yifan Qiu, Manlius, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 0 days.

(21) Appl. No.: 15/524,097

(22) PCT Filed: Nov. 17, 2015

(86) PCT No.: PCT/US2015/061001

§ 371 (c)(1),
(2) Date: May 3, 2017

(87) PCT Pub. No.: WO2016/099746

PCT Pub. Date: Jun. 23, 2016

(65) Prior Publication Data

US 2017/0356448 A1 Dec. 14, 2017

Related U.S. Application Data

(60) Provisional application No. 62/093,382, filed on Dec. 17, 2014.

(51) Int. Cl.
*F04C 29/02* (2006.01)
*F04C 29/00* (2006.01)
(Continued)

(52) U.S. Cl.
CPC ..... *F04C 29/028* (2013.01); *F04C 18/16* (2013.01); *F04C 18/20* (2013.01); *F04C 23/008* (2013.01);
(Continued)

(58) Field of Classification Search
CPC .... F04C 29/028; F04C 18/20; F04C 29/0085; F04C 23/008; F04C 29/0021; F04C 18/16;
(Continued)

(56) References Cited

U.S. PATENT DOCUMENTS 3,388,854 A 6/1968 Olofsson et al.
3,947,078 A 3/1976 Olsaker
(Continued)

FOREIGN PATENT DOCUMENTS

CN 1253239 A 5/2000
CN 102352842 A 2/2012
(Continued)

OTHER PUBLICATIONS

George C. Briley, P.E., Twin Screw Compressor Technology, Nov. 8, 2014, Technicold Services, Inc., San Antonio, Texas.
(Continued)

*Primary Examiner* — Emmanuel Duke
(74) *Attorney, Agent, or Firm* — Bachman & LaPointe, P.C.

(57) ABSTRACT

In a screw compressor (20), a male rotor suction end bearing (96) and discharge end bearing (90 1, 90 2, 90 3) mount the male rotor suction end shaft portion (39) and discharge end shaft portion (40). A female rotor suction end bearing (98) and discharge end bearing (92 1, 92 2) mount the female rotor suction end shaft portion (41) and discharge end shaft portion (42). At least one valve (182; 282; 382 1,382 2,382 3; 82; 582-1,582-2; 682-1,682-2; 782-1,782-2) is along a lubricant flowpath and has an energized condition and a de-energized condition. At least one restriction (184; 84-1, 84-2; 84-1, 84-2,84-3; 484 1,484-2,84-3; 84 1,84 2,584; 84-1,84-2,684; 84-1,84-2,784) is along the lubricant flowpath. The at least one valve and the at least one restriction
(Continued)

are positioned to create a lubricant pressure difference biasing the rotors away from a discharge end of the case.

21 Claims, 12 Drawing Sheets

(51) Int. Cl.

| | |
|---|---|
| ***F04C 18/16*** | (2006.01) |
| ***F04C 23/00*** | (2006.01) |
| ***F04C 18/20*** | (2006.01) |
| ***F25B 1/047*** | (2006.01) |
| ***F25B 31/00*** | (2006.01) |

(52) U.S. Cl.
CPC ..... *F04C 29/0021* (2013.01); *F04C 29/0085* (2013.01); *F04C 29/021* (2013.01); *F25B 1/047* (2013.01); *F25B 31/004* (2013.01); *F04C 2210/26* (2013.01); *F04C 2240/30* (2013.01); *F04C 2240/40* (2013.01); *F04C 2240/50* (2013.01); *F04C 2240/52* (2013.01); *F04C 2240/60* (2013.01); *F25B 2400/23* (2013.01); *F25B 2500/16* (2013.01)

(58) Field of Classification Search
CPC ..... F04C 29/021; F04C 2240/50; F04C 2210/26; F04C 2240/40; F04C 2240/30; F04C 2240/60; F04C 2240/52; F25B 1/047; F25B 31/004; F25B 2500/16; F25B 2400/23
See application file for complete search history.

(56) References Cited

U.S. PATENT DOCUMENTS

| | | | | |
|---|---|---|---|---|
| 4,173,440 | A | 11/1979 | Libis | |
| 4,383,802 | A | 5/1983 | Gianni et al. | |
| 4,730,995 | A | 3/1988 | Dewhirst | |
| 4,878,820 | A | 11/1989 | Doi et al. | |
| 4,915,514 | A | 4/1990 | Söderlund | |
| 5,411,388 | A | 5/1995 | Söderlund | |
| 5,626,470 | A | 5/1997 | Gerhardt | |
| 6,059,551 | A | 5/2000 | Amano et al. | |
| 6,186,758 | B1 | 2/2001 | Shaw | |
| 6,520,758 | B1 | 2/2003 | Sowards | |
| 7,677,051 | B2 * | 3/2010 | von Borstel | F04C 29/021 62/192 |
| 8,287,259 | B2 | 10/2012 | Yoshimura | |
| 8,752,674 | B2 | 6/2014 | Tomter | |
| 8,858,192 | B2 | 10/2014 | Shikano et al. | |
| 2005/0223726 | A1 * | 10/2005 | Lifson | F04C 18/165 62/196.2 |
| 2005/0257542 | A1 * | 11/2005 | von Borstel | F04C 29/021 62/192 |
| 2008/0038121 | A1 * | 2/2008 | Shoulders | F04C 29/061 417/312 |
| 2008/0095653 | A1 * | 4/2008 | Shoulders | F04C 18/16 418/83 |
| 2008/0131301 | A1 * | 6/2008 | Shoulders | F01C 21/02 418/1 |
| 2009/0148332 | A1 * | 6/2009 | Shoulders | F04C 18/16 418/201.2 |
| 2009/0311119 | A1 * | 12/2009 | Holden | F04C 18/16 418/1 |
| 2012/0207634 | A1 | 8/2012 | Heger et al. | |
| 2013/0058822 | A1 * | 3/2013 | Feller | F04C 18/16 418/84 |
| 2015/0337716 | A1 * | 11/2015 | Ouwenga | F01C 17/02 417/364 |
| 2016/0097572 | A1 * | 4/2016 | Feller | F04C 29/028 418/89 |

FOREIGN PATENT DOCUMENTS

| | | | |
|---|---|---|---|
| CN | 104136780 | A | 11/2014 |
| WO | 86/06798 | A1 | 11/1986 |
| WO | 2006/085865 | A2 | 8/2006 |
| WO | 2013/153970 | A1 | 10/2013 |
| WO | 2013/175817 | A1 | 11/2013 |

OTHER PUBLICATIONS

Bearings in Twin Screw Compressors, Application Handbook, Oct. 1998, SKF USA, Inc., Lansdale, Pennsylvania.
International Search Report and Written Opinion dated Feb. 25, 2016 for PCT/US2015/061001.
Chinese Office Action dated Oct. 9, 2018 for Chinese Patent Application No. 201580068195.6.

* cited by examiner

SCREW COMPRESSOR WITH OIL SHUTOFF AND METHOD

CROSS-REFERENCE TO RELATED APPLICATION

Benefit is claimed of U.S. Patent Application No. 62/093,382, filed Dec. 17, 2014, and entitled "Screw Compressor with Oil Shutoff and Method", the disclosure of which is incorporated by reference herein in its entirety as if set forth at length.

BACKGROUND

The disclosure relates to screw compressors. More particularly, the disclosure relates to lubrication of screw compressors.

Screw-type compressors are commonly used in air conditioning and refrigeration applications. In such a compressor, intermeshed male and female lobed rotors or screws are rotated about their axes to pump the working fluid (refrigerant) from a low pressure inlet end to a high pressure outlet end. During rotation, sequential lobes of the male rotor serve as pistons driving refrigerant downstream and compressing it within the space between an adjacent pair of female rotor lobes and the housing. Likewise sequential lobes of the female rotor produce compression of refrigerant within a space between an adjacent pair of male rotor lobes and the housing. The interlobe spaces of the male and female rotors in which compression occurs form compression pockets (alternatively described as male and female portions of a common compression pocket joined at a mesh zone). In one implementation, the male rotor is coaxial with an electric driving motor and is supported by bearings on inlet and outlet sides (ends) of its lobed working portion. Similarly, the female rotor may be supported by bearings on inlet and outlet sides of its lobed working portion. There may be multiple female rotors engaged to a given male rotor or vice versa.

When one of the interlobe spaces is exposed to an inlet port, the refrigerant enters the space essentially at suction pressure. As the rotors continue to rotate, at some point during the rotation the space is no longer in communication with the inlet port and the flow of refrigerant to the space is cut off. After the inlet port is closed, the refrigerant is compressed as the rotors continue to rotate. At some point during the rotation, each space intersects the associated outlet port and the closed compression process terminates. The inlet port and the outlet port may each be radial, axial, or a hybrid combination of an axial port and a radial port.

In operation, the pressure difference across the compressor produces a thrust load on the rotors. The pressure at the discharge end of the rotors will be higher than that at the suction end producing a net thrust force from the discharge end toward the suction end. To address such forces, the rotors may typically have a thrust bearing at one end. In a number of compressors, exemplary thrust bearings are unidirectional in that they absorb or react thrust loads in only one direction. This direction is selected to absorb the operational thrust load from the discharge end toward the suction end (hereinafter referred to as upstream thrust for ease of reference).

In particular situations such as unintended loss of power, the upstream thrust force is lost. The rotors may still have rotational inertia. The loss of the thrust force may, however, allow one or both rotors to shift downstream bringing the discharge end face of the lobed portion of such rotor into contact with an adjacent face of the outlet case (e.g., an upstream face of a discharge bearing case along a discharge end plane). This contact may be damaging.

One solution to such problems is to add an additional thrust bearing positioned to take up downstream thrust loads before the rotor end contacts the case. For example, this may involve mounting to one or both rotors an additional unidirectional thrust bearing generally similar to but oppositely oriented relative to the thrust bearing that takes up the upstream thrust loads. However, this adds cost and potentially compromises efficiency.

SUMMARY

One aspect of the disclosure involves a screw compressor comprising: a housing having a suction port and a discharge port. A male rotor has: an axis; a lobed portion extending from a suction end to a discharge end; a suction end shaft portion; and a discharge end shaft portion. A female rotor has: an axis; a lobed portion extending from a suction end to a discharge end and enmeshed with the male rotor lobed portion; a suction end shaft portion; and a discharge end shaft portion. A male rotor suction end bearing mounts the male rotor suction end shaft portion to the case. A male rotor discharge end bearing mounts the male rotor discharge end shaft portion to the case. A female rotor suction end bearing mounts the female rotor suction end shaft portion to the case. A female rotor discharge end bearing mounts the female rotor discharge end shaft portion to the case. At least one valve is along a lubricant flowpath and has an energized condition and a de-energized condition. At least one restriction is along the lubricant flowpath. The at least one valve and the at least one restriction are positioned to create a lubricant pressure difference biasing the rotors away from a discharge end of the case.

In one or more embodiments of any of the foregoing embodiments, the at least one valve is positioned to, in the de-energized condition, block lubricant flow to the suction end bearings.

In one or more embodiments of any of the foregoing embodiments, the at least one valve is positioned along the lubricant flowpath between the discharge end bearings and the suction end bearings.

In one or more embodiments of any of the foregoing embodiments, the at least one valve comprises a single valve positioned between the male rotor discharge end bearings and female rotor discharge end bearings at an upstream end of the single valve and the male rotor suction end bearings and the female rotor suction end bearings at a downstream end of the single valve.

In one or more embodiments of any of the foregoing embodiments, the at least one valve further comprises a second valve positioned along a branch of the lubricant flowpath between a trunk of the lubricant flowpath and the rotor lobes.

In one or more embodiments of any of the foregoing embodiments, the at least one valve comprises: a first valve positioned along a first branch of the lubricant flowpath between the male rotor discharge end bearings and the male rotor suction end bearings; and a second valve positioned along a second branch of the lubricant flowpath between female rotor discharge end bearings and the female rotor suction end bearings.

In one or more embodiments of any of the foregoing embodiments, the at least one valve further comprises: a third valve positioned along a third branch of the lubricant flowpath between a trunk of the lubricant flowpath and the rotor lobes.

In one or more embodiments of any of the foregoing embodiments, the at least one restriction is positioned along the lubricant flowpath between the discharge end bearings and the suction end bearings.

In one or more embodiments of any of the foregoing embodiments, at least one of said male rotor and said female rotor is supported without a bearing positioned to react thrust in a suction-to-discharge direction.

In one or more embodiments of any of the foregoing embodiments, a motor is within the case, the male rotor suction end shaft portion forming a shaft of the motor.

In one or more embodiments of any of the foregoing embodiments, there is a single said female rotor suction end bearing being a non-thrust roller bearing.

In one or more embodiments of any of the foregoing embodiments, one or both: the female rotor is supported by one or more non-thrust bearings and only one thrust bearing which is a uni-directional thrust bearing; and the male rotor is supported by one or more non-thrust bearings and one or more thrust bearings which are uni-directional thrust bearings of like orientation.

In one or more embodiments of any of the foregoing embodiments, the one thrust bearing supporting the female rotor is the female rotor discharge end bearing; and the one or more thrust bearings supporting the male rotor are the male rotor discharge end bearing.

Another aspect of the disclosure involves a vapor compression system comprising the compressor and further comprising: a heat rejection heat exchanger; an expansion device; a heat absorption heat exchanger; and a refrigerant flowpath extending through the compressor in a downstream direction from the suction port to the discharge port and passing from the discharge port sequentially through the heat rejection heat exchanger, the expansion device, and the heat absorption heat exchanger and returning to the suction port.

In one or more embodiments of any of the foregoing embodiments, the system further comprises a separator wherein the lubricant flowpath extends from the separator.

In one or more embodiments of any of the foregoing embodiments, a method for using the compressor comprises running the compressor in powered mode wherein: the motor drives the rotors to compress fluid drawn in through the suction port and discharge the compressed fluid through the discharge port; and the at least one valve is in the energized condition. The method further comprises terminating power so as to terminate driving of the motor; and shift the at least one valve to the de-energized condition to leave said lubricant pressure difference biasing the rotors away from said discharge end of the case.

In one or more embodiments of any of the foregoing embodiments, the shift causes the pressure difference by blocking the lubricant flowpath to the suction end bearings while leaving open the lubricant flowpath to the discharge end bearings.

In one or more embodiments of any of the foregoing embodiments: the lubricant pressure difference exists before the terminating; and the at least one restriction slows decay of the lubricant pressure difference after the terminating.

Another aspect of the disclosure involves a compressor comprising: a housing having a suction port and a discharge port. A male rotor has: an axis; a lobed portion extending from a suction end to a discharge end; a suction end shaft portion; and a discharge end shaft portion. A female rotor has: an axis; a lobed portion extending from a suction end to a discharge end and enmeshed with the male rotor lobed portion; a suction end shaft portion; and a discharge end shaft portion. A male rotor suction end bearing mounts the male rotor suction end shaft portion to the case. A male rotor discharge end bearing mounts the male rotor discharge end shaft portion to the case. A female rotor suction end bearing mounts the female rotor suction end shaft portion to the case. A female rotor discharge end bearing mounts the female rotor discharge end shaft portion to the case. At least one valve is along a lubricant flowpath and has an energized condition and a de-energized condition. At least one restriction is along the lubricant flowpath. The at least one valve is configured to: pass lubricant in a powered mode wherein the motor drives the rotors to compress fluid drawn in through the suction port and discharge the compressed fluid through the discharge port; and responsive to a loss of power produce a lubricant pressure difference biasing the rotors away from a discharge end of the case.

In one or more embodiments of any of the foregoing embodiments, the at least one valve is positioned to, in the de-energized condition, block the lubricant flowpath to the suction end bearings but not to the discharge end bearings.

Another aspect of the disclosure involves a method for operating a compressor, the compressor comprising: a housing having a suction port and a discharge port. A male rotor has: an axis; a lobed portion extending from a suction end to a discharge end; a suction end shaft portion; and a discharge end shaft portion. A female rotor has: an axis; a lobed portion extending from a suction end to a discharge end and enmeshed with the male rotor lobed portion; a suction end shaft portion; and a discharge end shaft portion. A male rotor suction end bearing mounts the male rotor suction end shaft portion to the case. A male rotor discharge end bearing mounts the male rotor discharge end shaft portion to the case. A female rotor suction end bearing mounts the female rotor suction end shaft portion to the case. A female rotor discharge end bearing mounts the female rotor discharge end shaft portion to the case. At least one valve is along a lubricant flowpath and has an energized condition and a de-energized condition. At least one restriction is along the lubricant flowpath. The method comprises: running the compressor in powered mode wherein: the motor drives the rotors to compress fluid drawn in through the suction port and discharge the compressed fluid through the discharge port; and the at least one valve is in the energized condition; and terminating power. The terminating of power: terminates driving of the motor; and shifts the at least one valve to the de-energized conditions to produce or leave a lubricant pressure difference biasing the rotors away from a discharge end of the case.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
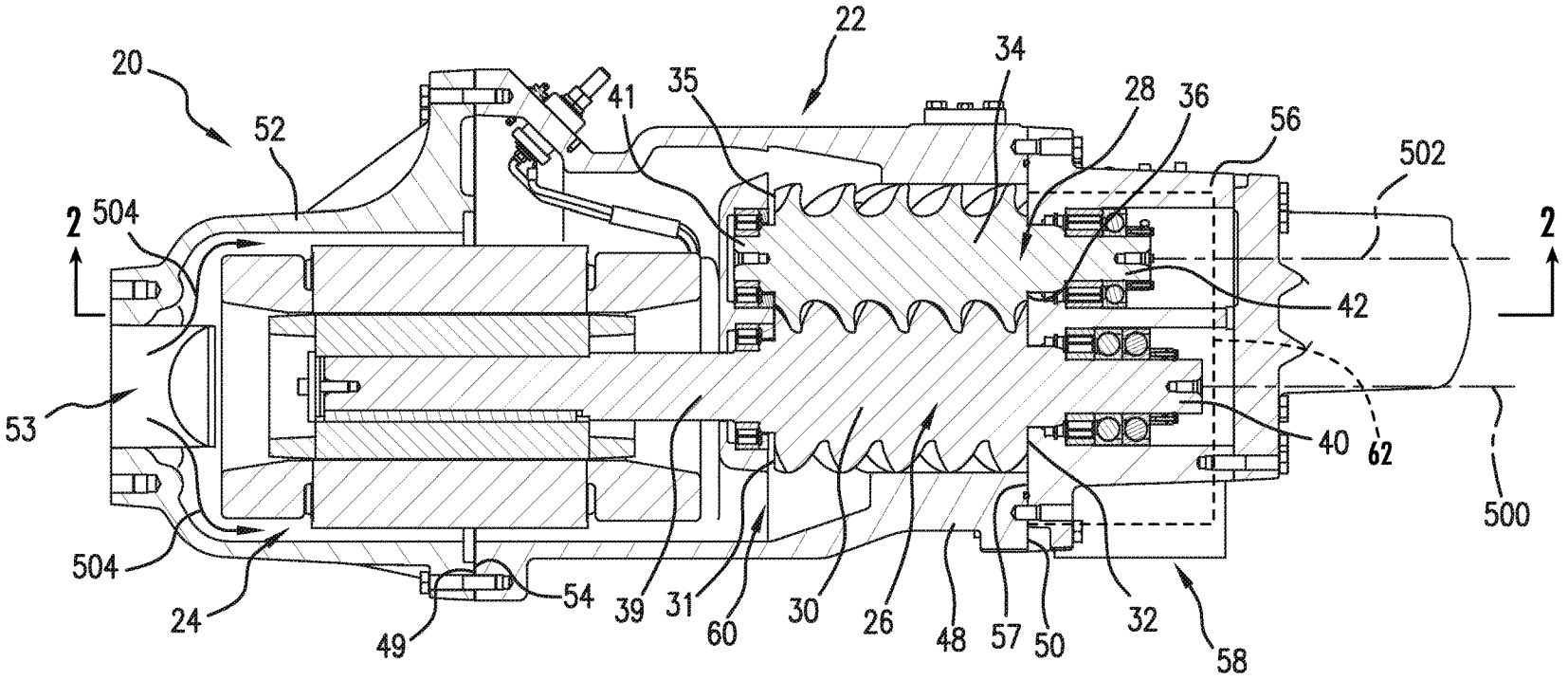
FIG. 1 is a central longitudinal sectional view of a compressor.

FIG. 1 shows a compressor 20 having a housing assembly 22 containing a motor 24 driving rotors 26 and 28 having respective central longitudinal axes 500 and 502. In the exemplary embodiment, the rotor 26 has a male lobed body or working portion 30 extending between a first end 31 and a second end 32. The working portion 30 is enmeshed with a female lobed body or working portion 34 of the female rotor 28. The working portion 34 has a first end 35 and a second end 36. Each rotor includes shaft portions (e.g., stubs 39, 40, 41, and 42 unitarily formed with the associated working portion) extending from the first and second ends of the associated working portion. Each of these shaft stubs is mounted to the housing by one or more bearing assemblies (discussed below) for rotation about the associated rotor axis.

In the exemplary embodiment, the motor is an electric motor having a rotor and a stator. One of the shaft stubs of one of the rotors 26 and 28 may be coupled to the motor's rotor so as to permit the motor to drive that rotor about its axis. When so driven in an operative first direction about the axis, the rotor drives the other rotor in an opposite second direction. The exemplary housing assembly 22 includes a rotor housing 48 having an upstream/inlet end face 49 approximately midway along the motor length and a downstream/discharge end face 50 essentially coplanar with the rotor body ends 32 and 36. Many other configurations are possible.

The exemplary housing assembly 22 further comprises a motor/inlet housing 52 having a compressor inlet/suction port 53 at an upstream end and having a downstream face 54 mounted to the rotor housing downstream face (e.g., by bolts through both housing pieces). The assembly 22 further includes an outlet/discharge housing 56 having an upstream face 57 mounted to the rotor housing downstream face and having an outlet/discharge port 58. The exemplary rotor housing, motor/inlet housing, and outlet housing 56 may each be formed as castings subject to further finish machining.

Surfaces of the housing assembly 22 combine with the enmeshed rotor bodies 30 and 34 to define inlet and outlet ports to compression pockets compressing and driving a refrigerant flow 504 from a suction (inlet) plenum 60 to a discharge (outlet) plenum 62. A series of pairs of male and female compression pockets are formed by the housing assembly 22, male rotor body 30 and female rotor body 34. Each compression pocket is bounded by external surfaces of enmeshed rotors, by portions of cylindrical surfaces of male and female rotor bore surfaces in the rotor case and continuations thereof along a slide valve, and portions of face 57.

Figure 2:
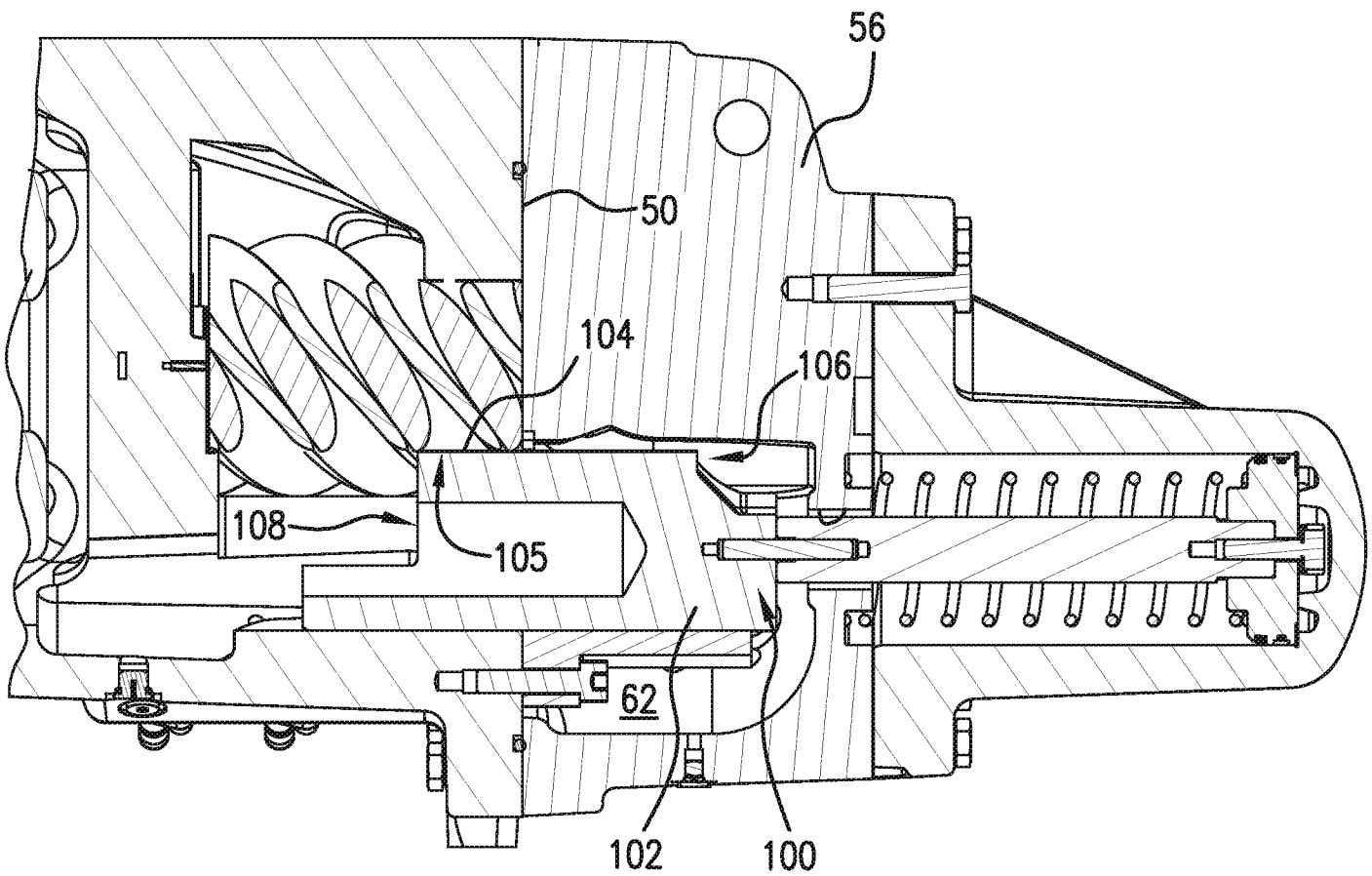
FIG. 2 is a partial longitudinal sectional view of the compressor of FIG. 1, taken along line 2-2.

For capacity control/unloading, the compressor has a slide valve 100 (FIG. 2) having a valve element 102. The valve element 102 has a portion 104 along the mesh zone between the rotors (i.e., along the high pressure cusp 105). The exemplary valve element has a first portion 106 at the discharge plenum and a second portion 108 at the suction plenum. The valve element is shiftable to control compressor capacity to provide unloading. The exemplary valve is shifted via linear translation parallel to the rotor axes between fully loaded and fully unloaded positions/conditions.

Figure 3:
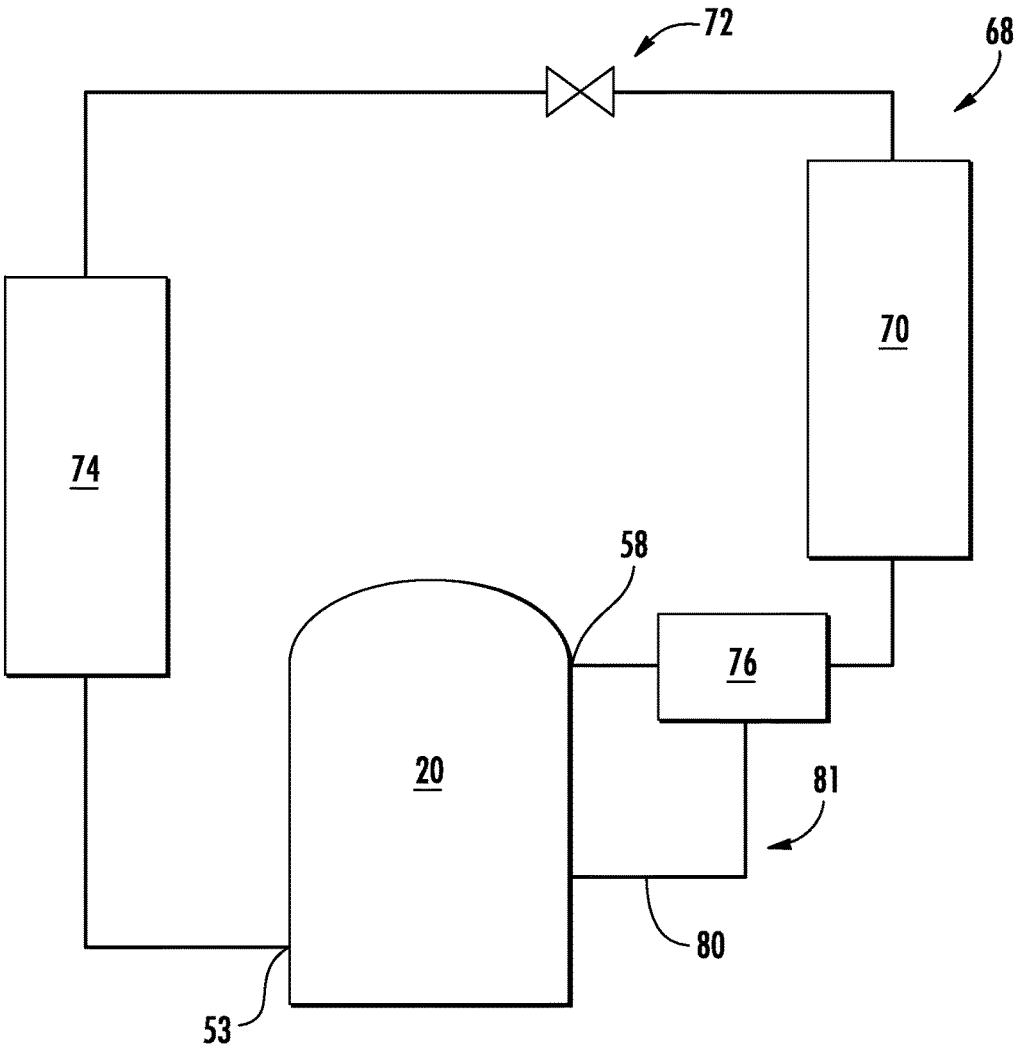
FIG. 3 is a schematic view of a vapor compression system including the compressor of FIG. 1.

FIG. 3 further shows a vapor compression system 68 including the compressor of FIG. 1. Along the main refrigerant flowpath proceeding downstream from the discharge port 58 are a first heat exchanger 70 (heat rejection heat exchanger in a normal operational mode), an expansion device 72, and a second heat exchanger 74 (heat absorption heat exchanger in the normal operational mode). From the second heat exchanger, the flowpath returns to the suction port 53. A lubrication system may draw lubricant from one or more locations in the vapor compression system to return it to the compressor. For example, a separator 76 may be positioned between the compressor and the first heat exchanger.

Figure 4:
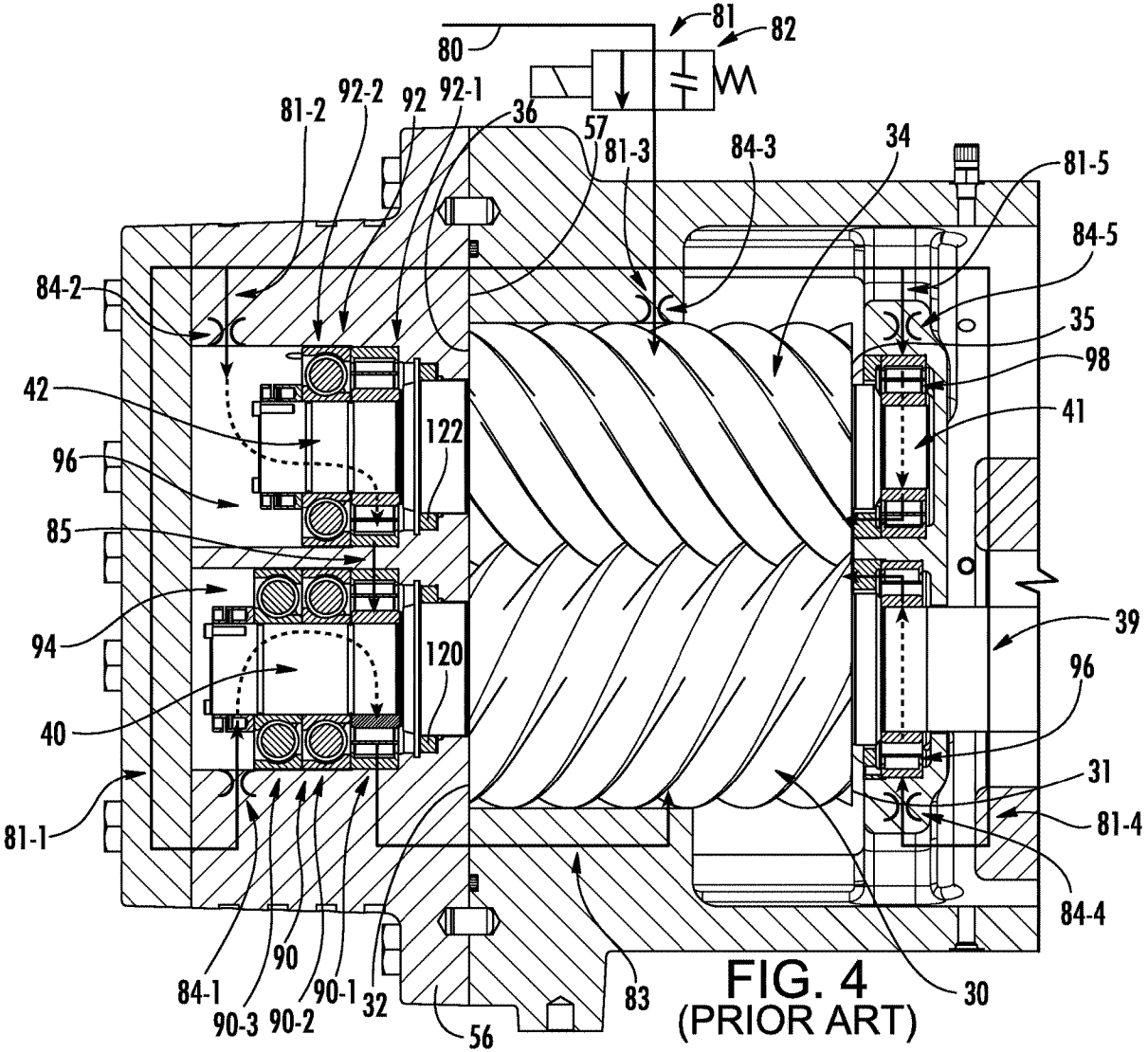
FIG. 4 (PRIOR ART)
FIG. 4 is a partial central longitudinal sectional view (generally opposite of FIG. 1) of a prior art compressor with lubricant flowpaths schematically shown.

FIGS. 4-9 schematically show lubrication (oil) flowpaths of various compressors. The basic hardware layout is representative of a slightly different compressor than shown in FIGS. 1 and 2 viewed 180° opposite relative to the corresponding features of FIG. 1. However, the differences in the basic hardware shown are merely for illustration and do not make a difference in the discussion of flowpaths. FIG. 4 schematically shows a prior art lubrication system with an oil supply line 80 (e.g., an oil return line from the separator 76). The oil flowpath 81 (e.g., a trunk thereof) from/through the line 80 passes through a valve 82. The exemplary valve 82 is a two-way, normally-closed, solenoid valve. The energized condition is the open condition. Thus, the default condition of the valve 82 upon loss of electrical power (de-energized condition) is to close. This protects the compressor from oil flooding when shut down. Downstream of the valve 82, the oil flowpath 81 branches from the trunk into a first branch 81-1 for lubricating the male rotor discharge end bearings 90, a second branch 81-2 for lubricating the female rotor discharge end bearings 92, a third branch 81-3 for lubricating the rotor lobes, a fourth branch 81-4 for lubricating the male rotor suction end bearing 96, and a fifth branch 81-5 for lubricating the female rotor suction end bearing 98. In this example, the branches 81-1 and 81-2 respectively branch off a larger branch for feeding the discharge end and the branches 84-4 and 84-5 also branch off another larger branch for feeding the suction end. The branches pass through respective orifices 84-1, 84-2, 84-3, 84-4, and 84-5. The branches 81-1 and 81-2 pass through their respective orifices into discharge end bearing compartments 94 and 96. The flows along the branches 81-1 and

81-2 then re-merge passing along a flowpath 83 and associated passageway to a port in the housing along the rotor lobes to provide additional rotor lobe lubrication beyond that passing along the flowpath 81-3. This merger may occur via a passageway 85 between the two bearing compartments (e.g., allowing oil to pass from the female compartment 96 to the male compartment 94). From the suction end bearings, the oil flow passes back to the enmeshing rotors and is, in turn, passed along with the flow from the third branch 81-3 and re-merged branches 81-1 to 81-2 to the discharge plenum 62. Thereafter, the oil is recovered by the separator and returned via the line 80.

In the exemplary embodiment, there is a single male rotor suction end bearing 96 and a single female rotor suction end bearing 98, both of which are non-thrust roller bearings. In the exemplary embodiment, there are three male rotor discharge end bearings 90, sequentially individually designated as: a non-thrust roller bearing 90-1 near the lobed working portion 30; a uni-directional thrust ball bearing 90-2 abutting the bearing 90-1 and configured to also resist upstream thrust; and a second similarly oriented uni-directional thrust ball bearing 90-3 abutting the bearing 90-2.

Similarly, there are two female rotor discharge end bearings: a non-thrust bearing 92-1; and a unidirectional thrust ball bearing 92-2 configured to resist upstream thrust.

FIG. 4 also shows seals 120, 122 sealing the case/housing relative to the shaft portions 40 and 42 between the discharge end bearings and the lobed working portions. The absence of a similar suction end seal helps facilitate passage of the lubricant flow from the suction end bearings 96 and 98 to the rotor lobe portions (e.g., at a port along the housing cusp or otherwise along one or more rotor bores).

Figure 5:
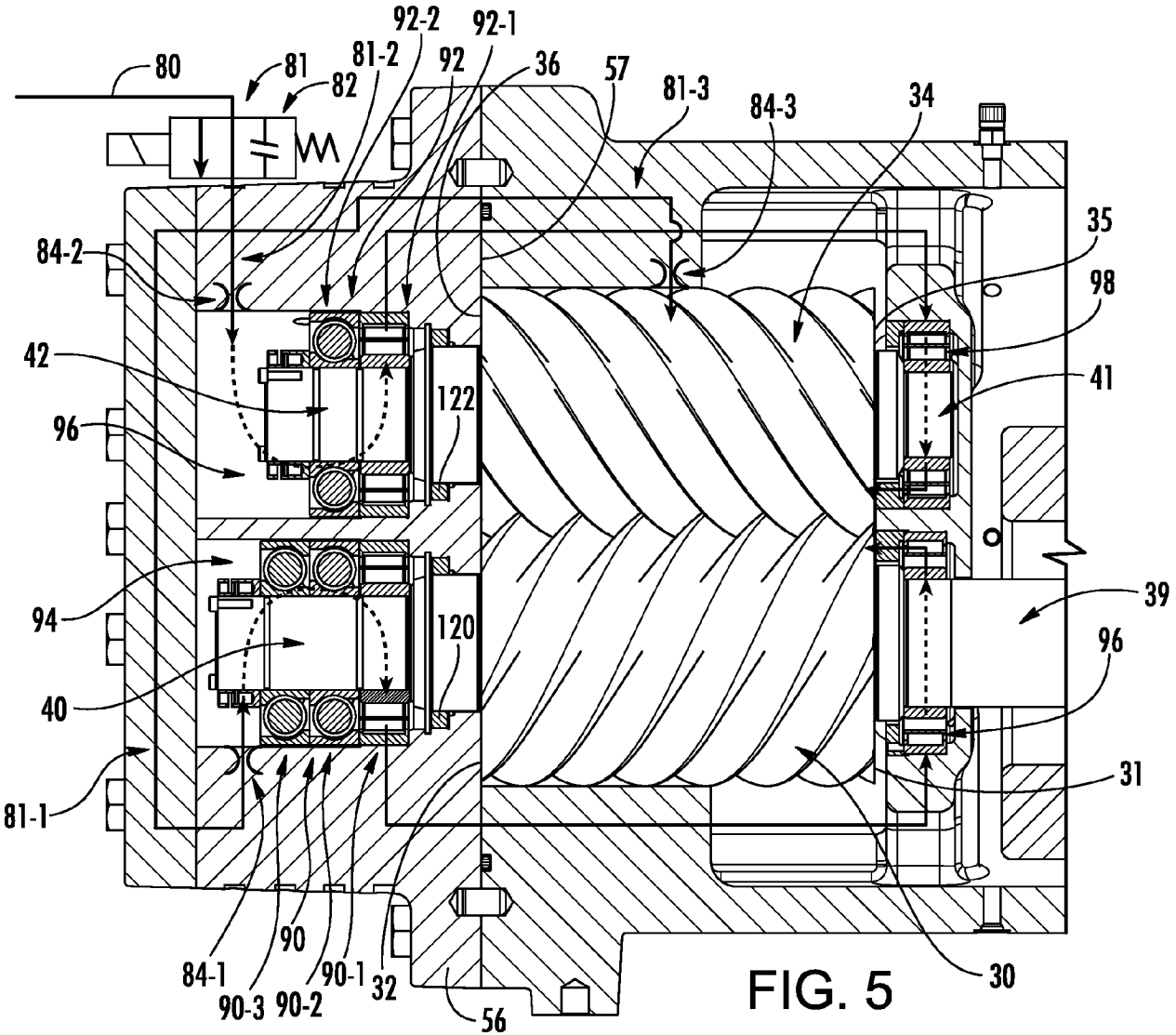
FIG. 5 is a partial longitudinal sectional view of a modified compressor of FIG. 4 with alternate lubricant flowpaths.

FIG. 5 schematically shows a modification of the FIG. 4 prior art lubrication system. The FIG. 5 modifications are generally based on arrangements shown in PCT/US14/60803, filed Oct. 16, 2014. Downstream of the valve 82, the oil flowpath 81 branches from the trunk into a first branch 81-1 for lubricating the male rotor discharge end bearings 90, a second branch 81-2 for lubricating the female rotor discharge end bearings 92, and a third branch 81-3 for lubricating the rotor lobes. The branches pass through respective orifices 84-1, 84-2, 84-3. The branches 81-1 and 81-2 pass through their respective orifices into discharge end bearing compartments 94 and 96. From the respective bearing compartments 94 and 96, the first and second branches pass through lines to feed the respective suction end bearings 96 and 98. From the suction end bearings, the oil flow passes back to the enmeshing rotors and is, in turn, passed along with the flow from the third branch 81-3 to the discharge plenum 62. Thereafter, the oil is recovered by the separator and returned via the line 80.

In the exemplary baseline prior art of FIG. 4 or the modified compressor of FIG. 5, the gas pressure is high near the discharge ends of the lobed working portions which produces an upstream thrust on the rotors counter to the general direction of refrigerant flow. This upstream force opens small gaps between the end faces 32 and 36 on the one hand and the adjacent face 57 of the discharge housing 56 on the other hand. This thrust force is resisted by the thrust bearings 90-2 and 90-3 on the male rotor and 92-2 on the female rotor.

Upon a sudden loss of electrical power, the refrigerant pressure will release by producing a reverse rotation of the rotors. This pressure release will cause a collapse of the gap between the ends 32, 36 and the face 57 potentially damaging the compressor. This problem can potentially be addressed with additional thrust bearings oriented to absorb downstream thrust. However, such bearings impose cost and performance penalties and may further impose additional manufacturing constraints (e.g., tolerances of certain spacings).

Accordingly, in several embodiments below, means are provided for creating an at least temporary lubricant pressure difference to bias the rotors away from the discharge end of the case to, upon loss of power, prevent impact of the discharge ends of the rotors with the adjacent face of the discharge case or mitigate the severity of such impact.

Figure 6:
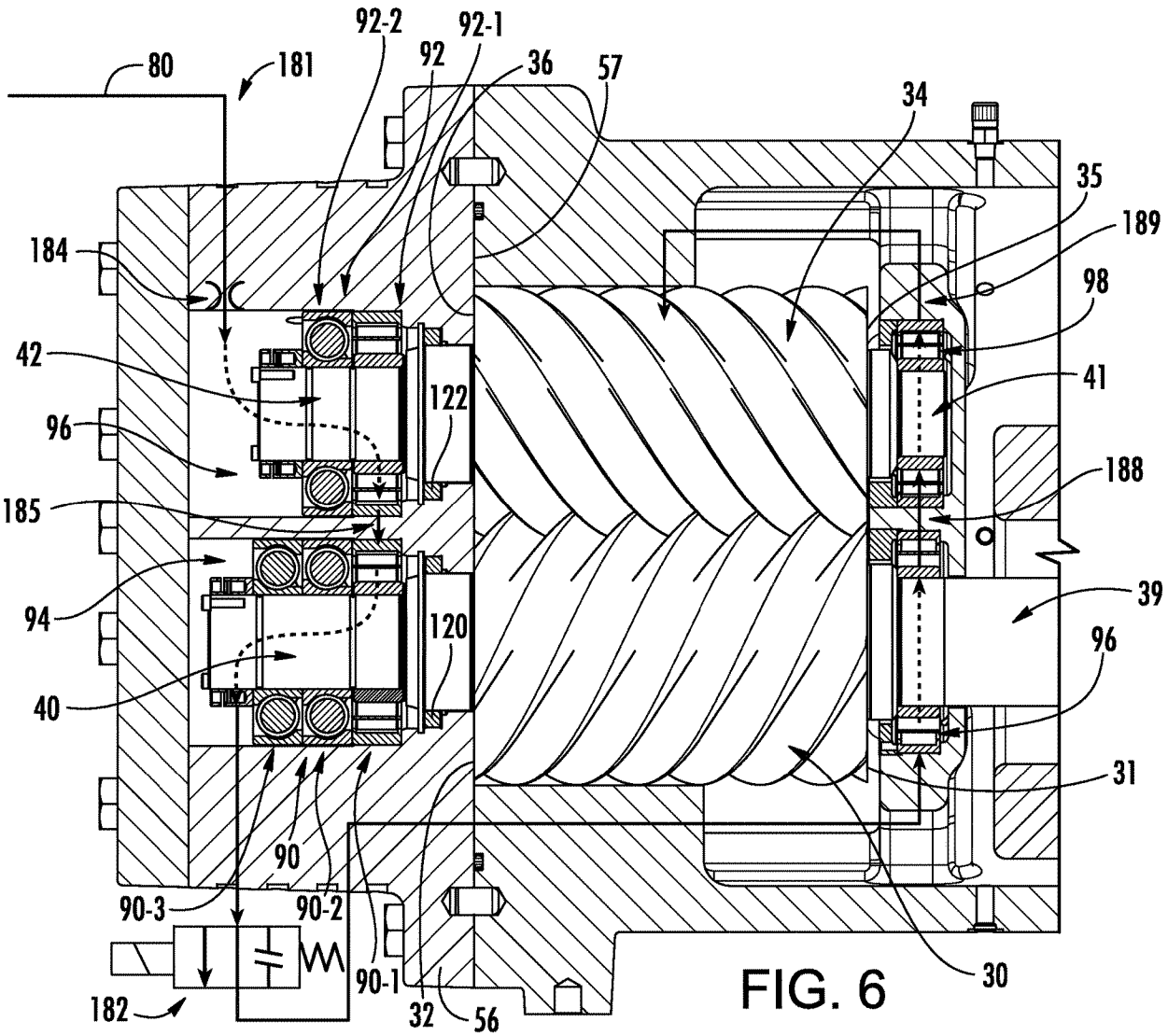
FIG. 6 is a partial central longitudinal sectional view of a first modification of the exemplary FIG. 5 compressor with lubricant flowpaths schematically shown.

FIG. 6 shows one configuration involving re-plumbing of the lubricant flowpath (and its associated passageway(s)) (shown as 181 instead of 81). In this embodiment, the flowpath 181 does not branch. A single orifice 184 is located upstream of one of the two discharge end bearing compartments (e.g., 96 in this example). A passageway 185 is provided between the two bearing compartments 94, 96 so that the flowpath 181 proceeds sequentially through one of the bearing compartments and into the next bearing compartment to lubricate the discharge end bearings of both rotors. Downstream of the second bearing compartment 94, the flowpath passes through a normally closed solenoid valve 182 which may be otherwise similar of the same as the solenoid valve 82 of the baseline compressor. Downstream of the valve 182, the lubricant flowpath/passageway proceeds to sequentially lubricate the two suction end bearings. In this example, the flowpath 181 passes to the male rotor suction end bearing and then through a passageway 188 to the female rotor suction end bearing and, therefrom, through a passageway 189 discharging to the rotor lobes (as did the baseline branch 81-3). In order to facilitate this sequential flow through the suction end bearings, they may have additional sealing relative to the FIG. 4 baseline to prevent/resist leakage directly from the suction end bearings to the rotors. Exemplary suction end seals may be constructed as conventional rotary shaft seals using elastomeric material such as PTFE to contact and seal against the rotating shaft. However, because the suction end of the screw rotors will be kept at suction pressure and the seals are required to hold only a small pressure differential (up to ~10 psi (~69 kPa)), such suction end seals may be constructed as non-contact type seals such as labyrinth. Instead of such seals, a plain ring collar may be attached to the rotor housing in order to create a tight gap (less than 0.5 mm) between the shaft and the rotor housing. Upon shutoff of the FIG. 6 compressor, closing of the valve 182 traps oil upstream thereof and causes an increase in oil pressure in the bearing compartments 94 and 96. This pressure exerts an upstream force on the rotors which resists the rotors moving downstream to contact the discharge case surface 57.

Figure 7:
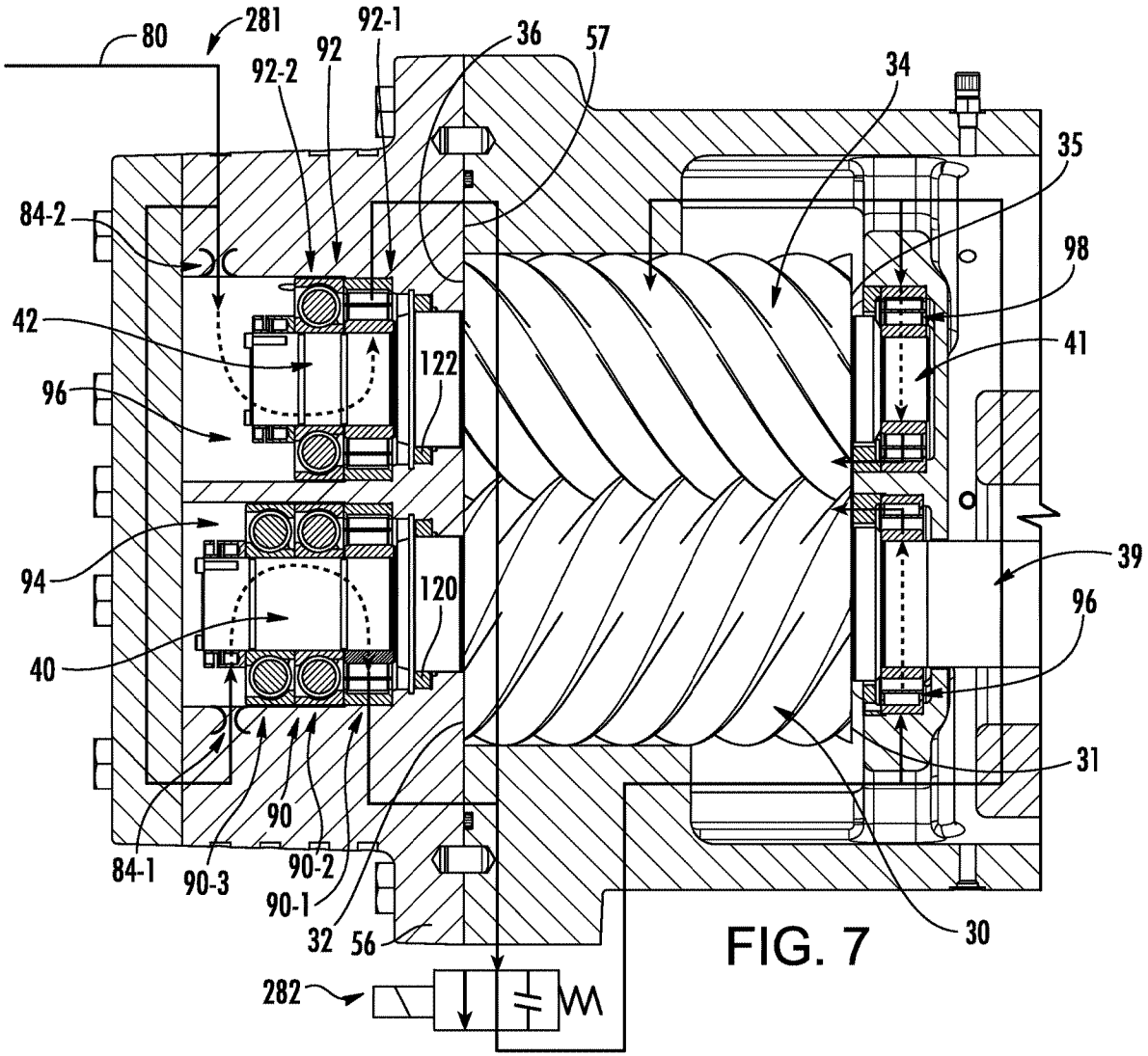
FIG. 7 is a partial central longitudinal sectional view of a second modification of the exemplary FIG. 5 compressor with lubricant flowpaths schematically shown.

The FIG. 7 embodiment may represent a less ambitious reengineering relative to the baseline FIG. 5 embodiment than does the FIG. 6 embodiment. The FIG. 7 embodiment maintains the orifices 84-1 and 84-2. The FIG. 7 embodiment also involves moving the two-way, normally-closed, solenoid valve 282 along a lubricant flowpath 281 downstream of the discharge end bearing compartments. The exemplary flowpath 281 thus merges downstream of the discharge end beatings and then splits after the valve 282 into three branches respectively serving the two suction end bearings and the rotors. This positioning of the solenoid valve, also creates the upstream-ward pressure on the rotors upon a loss of power in similar fashion to the FIG. 6 embodiment. As does the FIG. 5 embodiment, the lubricant flowpath branches to feed the two bearing compartments in parallel. The flowpath branches merge upon leaving the discharge end bearing compartments to pass to the valve 282 and, therefrom, branches again to feed the two suction end bearings and the rotor lobes in parallel. Accordingly, flow passes from the suction end bearings to the rotors as in the FIG. 5 embodiment.

Figure 8:
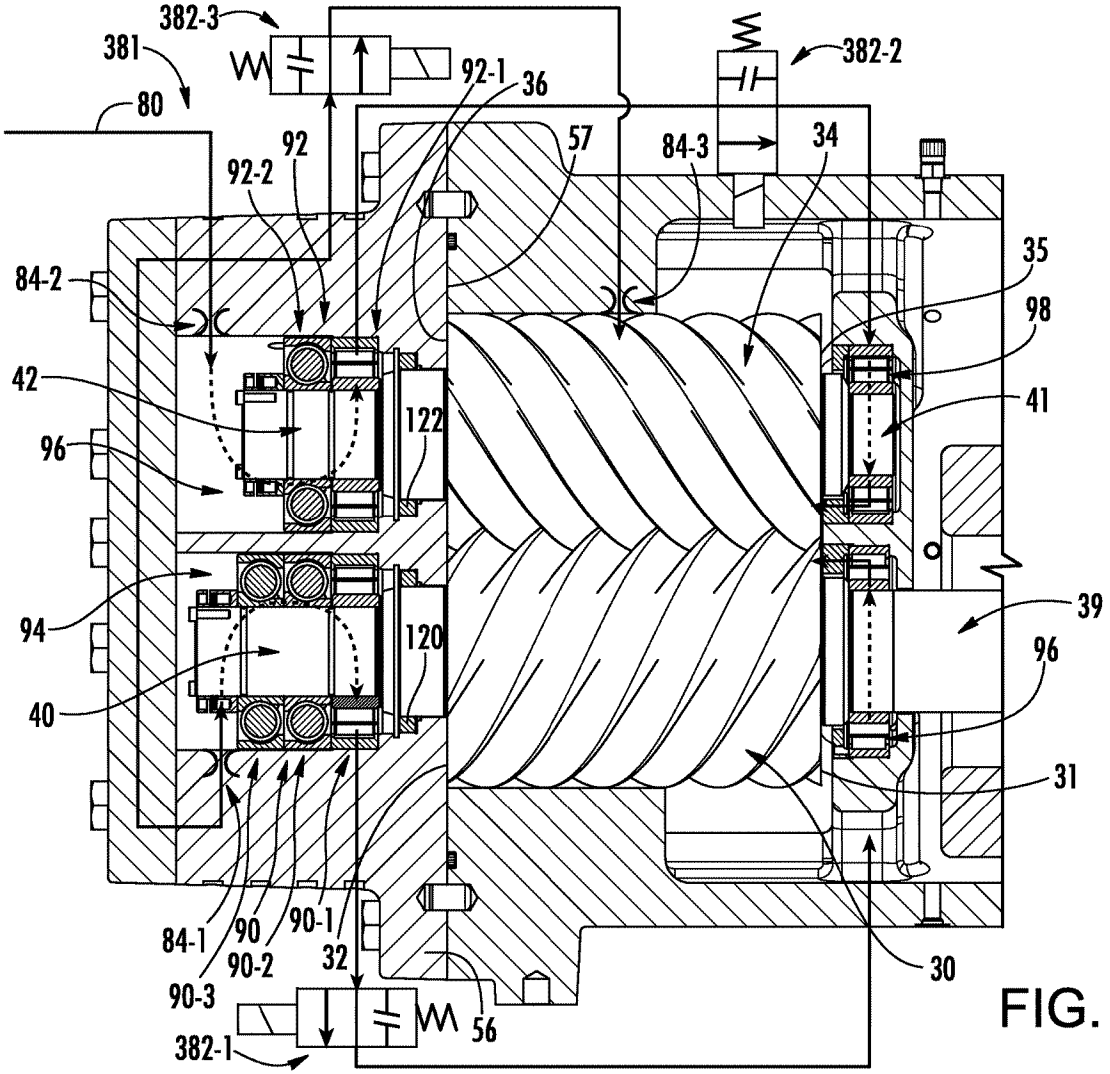
FIG. 8 is a partial central longitudinal sectional view of a third modification of the exemplary FIG. 5 compressor with lubricant flowpaths schematically shown.

FIG. 8 shows another embodiment that generally preserves oil flowpath/passageway 381 configurations from the FIG. 5 embodiment. In order to do this, three solenoid valves 382-1, 382-2, 382-3 respectively block the three branches feeding the male and female suction end bearings and the rotor lobes. Accordingly, when these valves lose power, high pressure lubricant will be isolated in the discharge end bearing compartments and provide the aforementioned biasing force.

Figure 9:
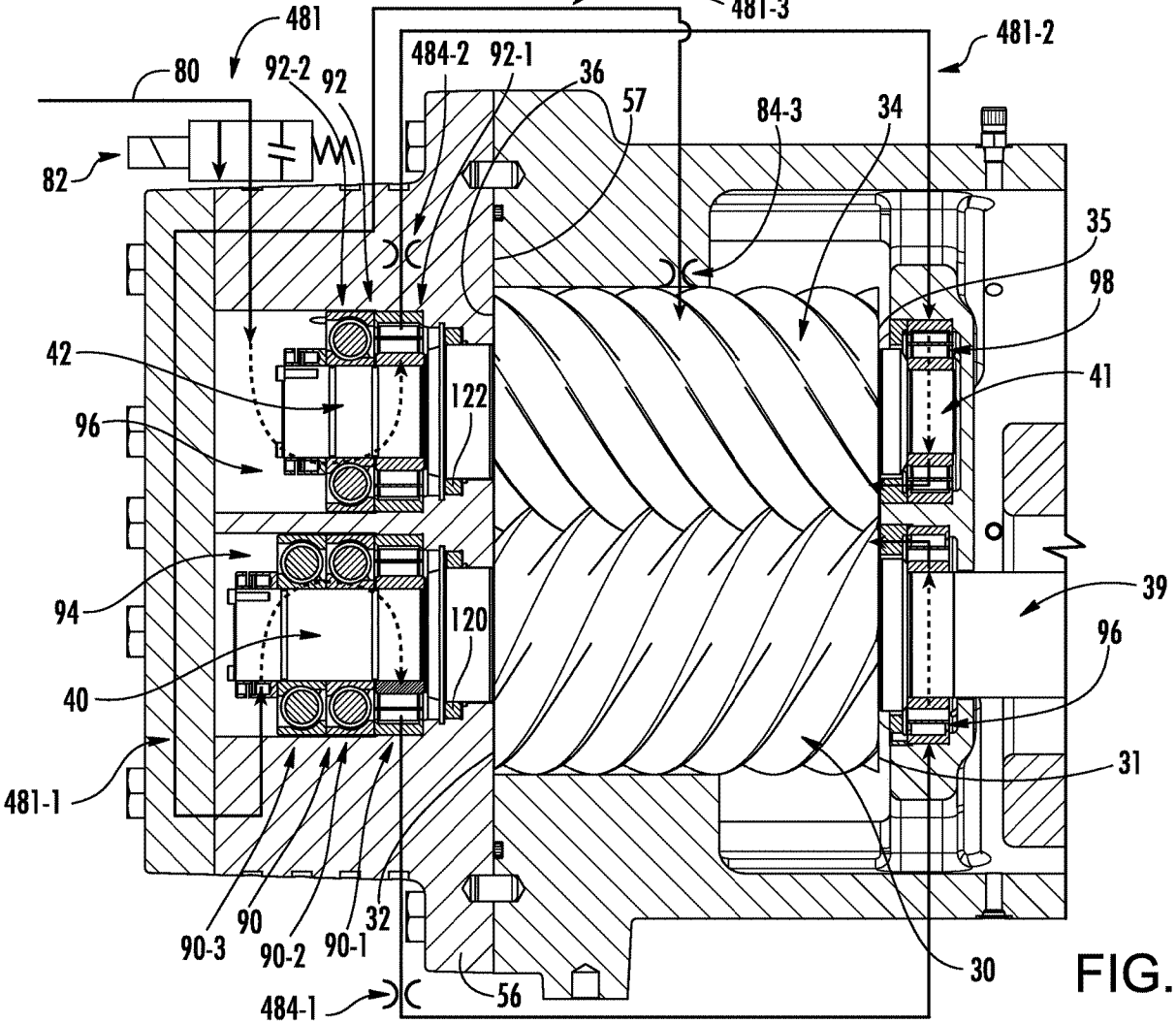
FIG. 9 is a partial central longitudinal sectional view of a fourth modification of the exemplary FIG. 5 compressor with lubricant flowpaths schematically shown.

FIG. 9 shows a further variation wherein the solenoid valve is left in its original FIG. 5 position but the orifices 484-1, 484-2 associated with the bearings are relocated along the respective associated branches of the flowpath 481 (with branches 48-1, 481-2, and 481-3) downstream of the discharge end bearing compartments. In normal operation, the orifices provide discharge end bearing compartment pressure higher than lubricant pressure as introduced to the suction end bearings and rotor lobes. Upon loss of power, this pressure difference will instantaneously remain but will quickly dissipate. However, the orifices may be sized so that the dissipation time is sufficient to avoid or mitigate rotor impact with the discharge case face 57.

Figure 10:
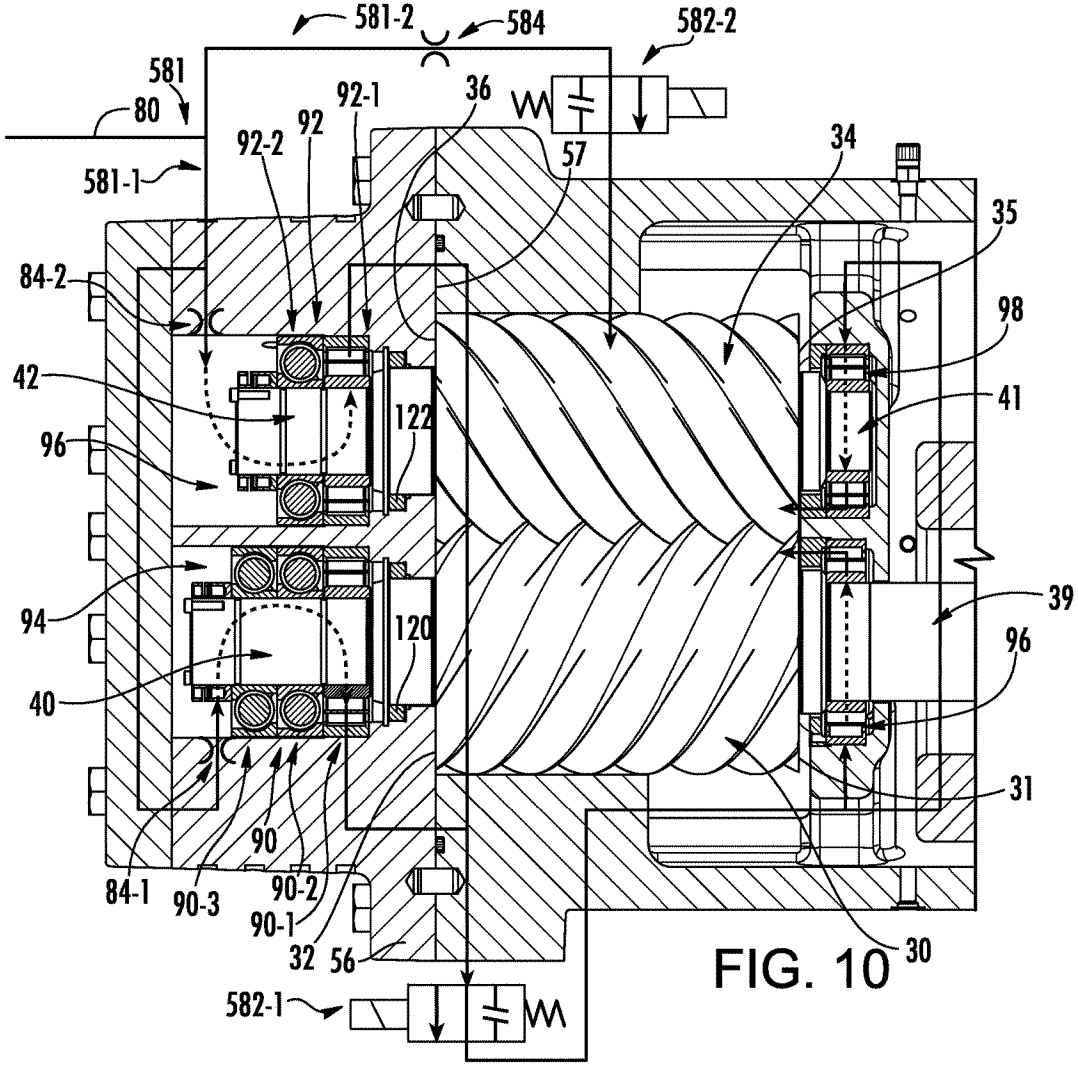
FIG. 10 is a partial central longitudinal sectional view of a fifth modification of the exemplary FIG. 5 compressor with lubricant flowpaths schematically shown.

FIG. 10 shows a further variation otherwise similar to FIG. 7 with an additional flowpath branch 581-2 of the flowpath 581 in order to feed the rotor lobes. Thus, whereas a FIG. 7 branch feeding the rotor lobes branches off the FIG. 7 flowpath 281 downstream of the discharge end bearings, the branch 581-2 branches off upstream of the discharge end bearings. The flowpath branch 581-1 still sequentially feeds the discharge end bearings and suction end bearings passing through an intervening valve 582-1 in similar fashion to the FIG. 7 valve 282. The branch 581-2 bears an orifice 584 upstream of a normally closed solenoid valve 582-2 otherwise similar to solenoid valves discussed above.

Figure 11:
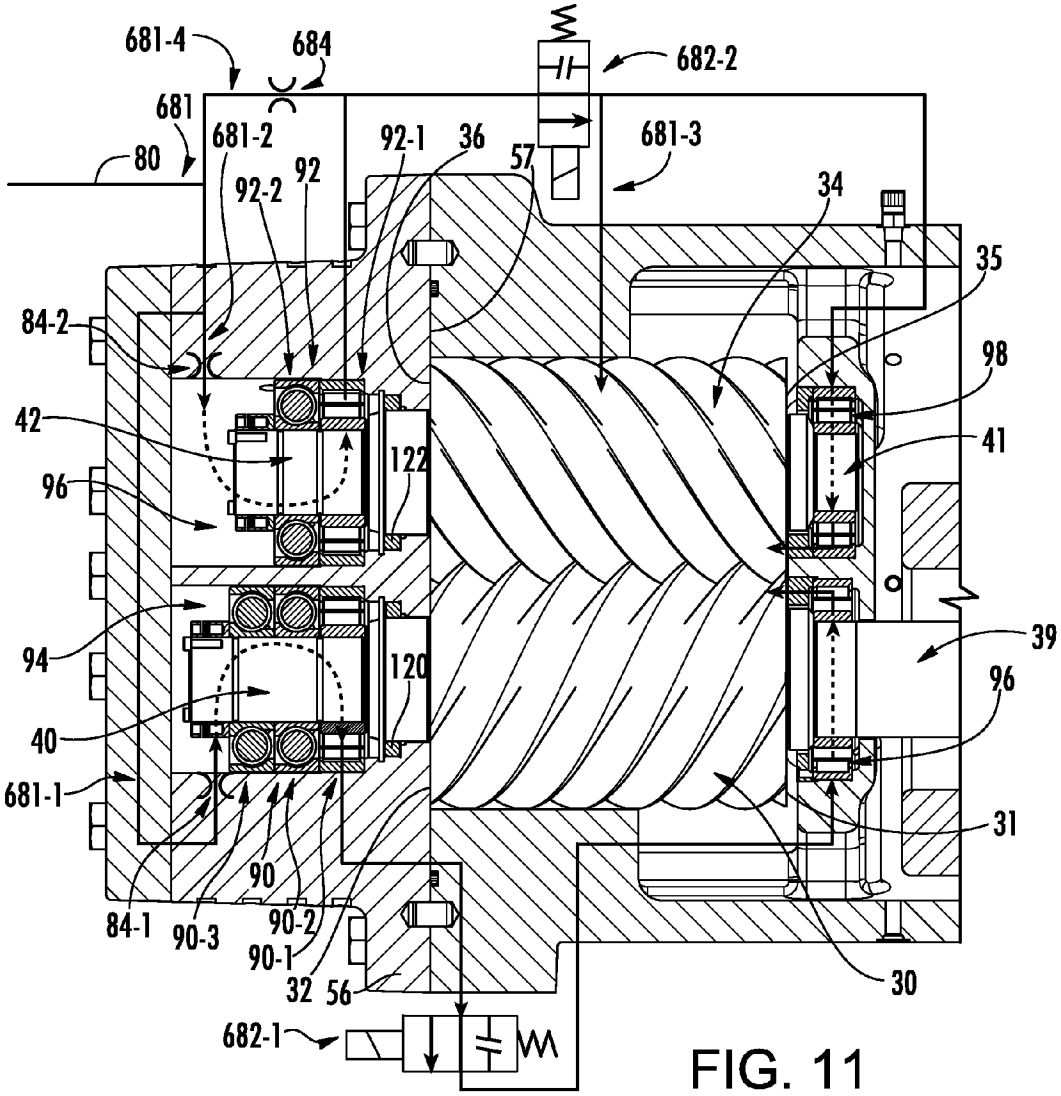
FIG. 11 is a partial central longitudinal sectional view of a sixth modification of the exemplary FIG. 5 compressor with lubricant flowpaths schematically shown.

FIG. 11 shows a further variation more similar to the FIG. 8 embodiment with a lubrication flowpath 681. Flow proceeds from the discharge end bearings of a given rotor to the suction end bearings of that rotor passing through respective solenoid valves 682-1 and 682-2. Whereas the FIG. 8 embodiment adds a third dedicated solenoid valve 382-3 and associated main flow branch for rotor lubrication, the FIG. 11 embodiment branches rotor lubrication off of one of the other two branches intermediate the two associated rotor bearings. In FIG. 11, this branch 681-3 is off the flowpath branch 681-2 that lubricates the discharge end bearings and the suction end bearing of the female rotor. The valve 682-2 is positioned downstream of the female rotor discharge end bearings and upstream of the divergence of the branch 681-3 feeding the rotors from the branch feeding the female rotor suction end bearings. Additionally, a bypass branch 681-4 provides communication from the trunk to the upstream end of the valve 682-2 in parallel with the portion of the flowpath 681-2 through the female rotor discharge end bearings 92 so as to bypass such bearings 92. This bypass branch 681-4 bears a restriction 684. The restriction functions to limit flow through the branch 681-4 to approximately the amount needed for the branch 681-3 for rotor lubrication. Thus, flow rate to the suction end bearings 98 of the female rotor may be substantially the same as the flow rate through the discharge end bearings 92.

Figure 12:
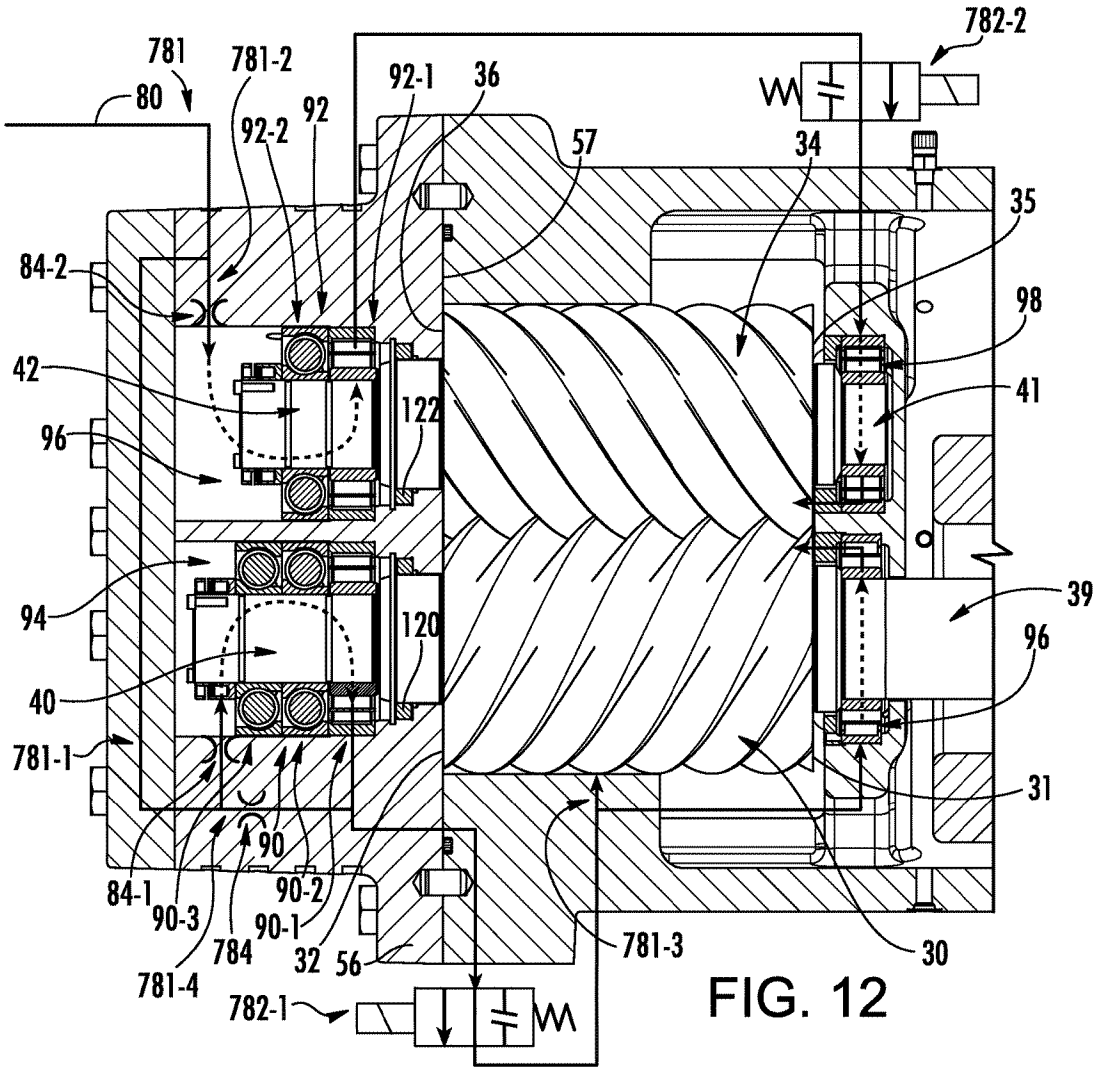
FIG. 12 is a partial central longitudinal sectional view of a seventh modification of the exemplary FIG. 5 compressor with lubricant flowpaths schematically shown.

The FIG. 12 variation has a lubrication flowpath 781 otherwise similar to the FIG. 11 variation but which shifts the feeding of the rotors from a branch off the female rotor bearing flowpath 781-2 to a branch 781-3 off the male rotor bearing lubrication flowpath 781-1. Thus, a similar bypass 781-4 to the bypass 681-4 of FIG. 11 is provided but associated with the male rotor flowpath/branch 781-1. Similarly, valves associated with the respective male rotor bearing flowpath and female rotor bearing flowpath are shown as 782-1 and 782-2.

The compressor and its flowpaths, restrictions (orifices), valves, and the like may be manufactured by various existing techniques. Lines may be separate conduits and/or integral passageways within housing castings/machinings.

Exemplary orifices are fixed restrictions. Conventional orifices used for lubrication may be used. Typical examples have circular-cross-sectioned apertures (e.g., in a flat plate). The orifice is sized to create a pressure differential when the oil is passing through (while the associated solenoid valve, if any, is open). An exemplary pressure differential across the orifice is at least 50% of a pressure difference between the discharge pressure and the suction pressure of the compressor.

Desired orifice size may be influenced by size and other details of the compressor. With an exemplary circular cross-section, exemplary internal diameter is between 0.2 mm and 2 mm. Also, exemplary orifice length (along the flowpath) may be between 0.1 mm and 10 mm. The orifice cross-sectional area may represent less than an exemplary 10% of the characteristic cross-sectional area of the associated line/conduit/flowpath away from the orifice (more narrowly less than 5% or an exemplary 0.10% to 5.0%).

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic compressor, details of such configuration or its associated use may influence details of particular implementations. This may include three-rotor compressors among other variations. Accordingly, other embodiments are within the scope of the following claims.

What is claimed is:

1. A screw compressor (20) comprising:

a housing having a suction port (53) and a discharge port (58);

a male rotor (26) having:

an axis (500);

a lobed portion (30) extending from a suction end (31) to a discharge end (32);

a suction end shaft portion (39); and a discharge end shaft portion (40);

a female rotor (28) having:

an axis (502);

a lobed portion (34) extending from a suction end (35) to a discharge end (36) and enmeshed with the male rotor lobed portion;

a suction end shaft portion (41); and a discharge end shaft portion (42);

a male rotor suction end bearing (96) mounting the male rotor suction end shaft portion to the case;

a male rotor discharge end bearing (90-1, 90-2, 90-3) mounting the male rotor discharge end shaft portion to the case;

a female rotor suction end bearing (98) mounting the female rotor suction end shaft portion to the case;

a female rotor discharge end bearing (92-1, 92-2) mounting the female rotor discharge end shaft portion to the case;

a lubricant flowpath (181; 281; 381; 481; 581; 681; 781);

at least one valve (182; 282; 382-1,382-2,382-3; 82; 582-1,582-2; 682-1, 682-2; 782-1, 782-2) along the lubricant flowpath and having an energized condition and a de-energized condition; and at least one restriction (184; 84-1,84-2; 84-1,84-2,84-3; 484-1,484-2,84-3; 84-1,84-2,584; 84-1,84-2,684; 84-1, 84-2,784) along the lubricant flowpath, wherein:

the at least one valve and the at least one restriction are positioned to create a lubricant pressure difference biasing the rotors away from a discharge end of the case.

2. The compressor of claim 1 wherein:

the at least one valve is positioned to, in the de-energized condition, block lubricant flow to the suction end bearings (96, 98) but not the discharge end bearings (90-1, 90-2, 90-3, 92-1, 92-2).

3. The compressor of claim 2 wherein:

the at least one valve is positioned along a lubricant flowpath (181; 281; 381; 581; 681; 781) downstream of the discharge end bearings (90-1, 90-2, 90-3, 92-1, 92-2) and upstream of the suction end bearings (96, 98).

4. The compressor of claim 3 wherein:

the at least one valve comprises a single valve positioned between the male rotor discharge end bearings and female rotor discharge end bearings at an upstream end of the single valve along the lubricant flowpath and the male rotor suction end bearings and the female rotor suction end bearings at a downstream end of the single valve along the lubricant flowpath.

5. The compressor of claim 4 wherein the at least one valve further comprises:

a second valve positioned along a branch of the lubricant flowpath between a trunk of the lubricant flowpath and the rotor lobes and separate from a branch said single valve.

6. The compressor of claim 3 wherein the at least one valve comprises:

a first valve positioned along a first branch of the lubricant flowpath between the male rotor discharge end bearings and the male rotor suction end bearings; and a second valve positioned along a second branch of the lubricant flowpath between female rotor discharge end bearings and the female rotor suction end bearings.

7. The compressor of claim 6 wherein the at least one valve further comprises:

a third valve positioned along a third branch of the lubricant flowpath between a trunk of the lubricant flowpath and the rotor lobes.

8. The compressor of claim 1 wherein:

the at least one restriction is positioned along a lubricant flowpath (81) between the discharge end bearings (90-1, 90-2, 90-3, 92-1, 92-2) and the suction end bearings (96, 98).

9. The compressor of claim 1 wherein:

at least one of said male rotor and said female rotor is supported without a bearing positioned to react thrust in a suction-to-discharge direction.

10. The compressor of claim 1 further comprising:

a motor within the case, the male rotor suction end shaft portion forming a shaft of the motor.

11. The compressor of claim 1 wherein:

there is a single said female rotor suction end bearing being a non-thrust roller bearing.

12. The compressor of claim 1 wherein one or both:

the female rotor is supported by one or more non-thrust bearings and only one thrust bearing which is a uni-directional thrust bearing; and the male rotor is supported by one or more non-thrust bearings and one or more thrust bearings which are uni-directional thrust bearings of like orientation.

13. The compressor of claim 12 wherein:

the one thrust bearing supporting the female rotor is the female rotor discharge end bearing; and the one or more thrust bearings supporting the male rotor are the male rotor discharge end bearing.

14. A vapor compression system (68) comprising the compressor of claim 1 and further comprising:

a heat rejection heat exchanger (70);

an expansion device (72);

a heat absorption heat exchanger (74); and a refrigerant flowpath extending through the compressor in a downstream direction from the suction port to the discharge port and passing from the discharge port sequentially through the heat rejection heat exchanger, the expansion device, and the heat absorption heat exchanger and returning to the suction port.

15. The system of claim 14 further comprising a separator (76) wherein:

the lubricant flowpath extends from the separator.

16. A method for using the compressor of claim 1, the method comprising:

running the compressor in powered mode wherein:

the motor drives the rotors to compress fluid drawn in through the suction port and discharge the compressed fluid through the discharge port; and the at least one valve is in the energized condition; and terminating power so as to:

terminate driving of the motor; and shift the at least one valve to the de-energized condition to leave said lubricant pressure difference biasing the rotors away from said discharge end of the case.

17. The method of claim 16 wherein:

the shift causes the pressure difference by blocking the lubricant flowpath to the suction end bearings while leaving open the lubricant flowpath to the discharge end bearings.

18. The method of claim 16 wherein:

the lubricant pressure difference exists before the terminating; and the at least one restriction slows decay of the lubricant pressure difference after the terminating.

19. A compressor comprising:

a housing having a suction port (53) and a discharge port (58);

a male rotor (26) having:

an axis (500);

a lobed portion (30) extending from a suction end (31) to a discharge end (32);

a suction end shaft portion (39); and a discharge end shaft portion (40);

a female rotor (28) having:

an axis (502);

a lobed portion (34) extending from a suction end (35) to a discharge end (36) and enmeshed with the male rotor lobed portion;

a suction end shaft portion (41); and a discharge end shaft portion (42);

a male rotor suction end bearing (96) mounting the male rotor suction end shaft portion to the case;

a male rotor discharge end bearing (90-1, 90-2, 90-3) mounting the male rotor discharge end shaft portion to the case;

a female rotor suction end bearing (98) mounting the female rotor suction end shaft portion to the case;

a female rotor discharge end bearing (92-1, 92-2) mounting the female rotor discharge end shaft portion to the case;

a lubricant flowpath (181; 281; 381; 481; 581; 681; 781);

at least one valve (182; 282; 382-1,382-2,382-3; 82; 582-1, 582-2; 682-1, 682-2; 782-1, 782-2) along the lubricant flowpath and having an energized condition and a de-energized condition; and at least one restriction (184; 84-1,84-2; 84-1,84-2,84-3; 484-1,484-2,84-3; 84-1,84-2,584; 84-1,84-2,684; 84-1, 84-2,784) along the lubricant flowpath, wherein the at least one valve is configured to:

pass lubricant in a powered mode wherein the motor drives the rotors to compress fluid drawn in through the suction port and discharge the compressed fluid through the discharge port; and responsive to a loss of power produce a lubricant pressure difference biasing the rotors away from a discharge end of the case.

20. The compressor of claim 19 wherein:

the at least one valve is positioned to, in the de-energized condition, block the lubricant flowpath to the suction end bearings but not to the discharge end bearings.

21. A method for operating a compressor, the compressor comprising:

a housing having a suction port (53) and a discharge port (58);

a male rotor (26) having:

an axis (500);

a lobed portion (30) extending from a suction end (31) to a discharge end (32);

a suction end shaft portion (39); and a discharge end shaft portion (40);

a female rotor (28) having:

an axis (502);

a lobed portion (34) extending from a suction end (35) to a discharge end (36) and enmeshed with the male rotor lobed portion;

a suction end shaft portion (41); and a discharge end shaft portion (42);

a male rotor suction end bearing (96) mounting the male rotor suction end shaft portion to the case;

a male rotor discharge end bearing (90-1, 90-2, 90-3) mounting the male rotor discharge end shaft portion to the case;

a female rotor suction end bearing (98) mounting the female rotor suction end shaft portion to the case;

a female rotor discharge end bearing (92-1, 92-2) mounting the female rotor discharge end shaft portion to the case;

a lubricant flowpath (181; 281; 381; 481; 581; 681; 781);

at least one valve (182; 282; 382-1,382-2,382-3; 82; 582-1, 582-2; 682-1, 682-2; 782-1, 782-2) along the lubricant flowpath and having an energized condition and a de-energized condition; and at least one restriction (184; 84-1,84-2; 84-1,84-2,84-3; 484-1,484-2,84-3; 84-1,84-2,584; 84-1,84-2,684; 84-1, 84-2,784) along the lubricant flowpath, the method comprising:

running the compressor in powered mode wherein:

the motor drives the rotors to compress fluid drawn in through the suction port and discharge the compressed fluid through the discharge port; and the at least one valve is in the energized condition; and terminating power so as to:

terminate driving of the motor; and shift the at least one valve to the de-energized conditions to produce or leave a lubricant pressure difference biasing the rotors away from a discharge end of the case.

* * * * *